US006125494A

United States Patent [19]

Morad

[11] Patent Number: 6,125,494

[45] Date of Patent: Oct. 3, 2000

[54] SELF-WRINGING MOP

[75] Inventor: Fred I. Morad, Toluca Lake, Calif.

[73] Assignee: Worldwide Integrated Resources, Inc., Commerce, Calif.

[21] Appl. No.: 09/221,184

[22] Filed: Dec. 23, 1998

[51] Int. Cl.[7] ..... A47L 13/142

[52] U.S. Cl. ..... 15/120.2; 15/120.1

[58] Field of Search ..... 15/117.1, 120.1, 15/120.2, 228, 229.1

[56] References Cited

U.S. PATENT DOCUMENTS

| | | | |
|---|---|---|---|
| 1,218,618 | 3/1917 | Bauer . | |
| 1,426,440 | 8/1922 | Zieschang | 15/119.1 |
| 1,710,190 | 4/1929 | Regan . | |
| 2,066,096 | 12/1936 | Currie . | |
| 2,230,101 | 1/1941 | Bakemeier . | |
| 2,365,437 | 12/1944 | Schaefer . | |
| 3,364,512 | 1/1968 | Yamashita et al. | 15/119.1 |
| 4,464,807 | 8/1984 | Weiss . | |
| 5,509,163 | 4/1996 | Morad . | |
| 5,675,857 | 10/1997 | Hirse | 15/119.1 |
| 5,724,694 | 3/1998 | Lewis . | |
| 5,819,356 | 10/1998 | Cann | 15/120.1 |
| 5,850,658 | 12/1998 | Specht | 15/120.1 |

FOREIGN PATENT DOCUMENTS

| | | | |
|---|---|---|---|
| 2622785 | 5/1989 | France | 15/120.1 |

*Primary Examiner*—Terrence R. Till
*Attorney, Agent, or Firm*—Thomas I. Rozsa; Tony D. Chen; Jerry Fong

[57] ABSTRACT

A self-wringing mop for removing liquid from the strands of a mop head which includes a handle member, a tubular wringing member disposed over a lowermost portion the handle member, a ratchet mechanism for longitudinal and rotational movement of the tubular wringing member, and the mop head attached to one end of the handle member just below the tubular wringing member. The tubular wringing member has a plurality of protruding ribs which are integrally formed with the interior surface. The longitudinal and rotational movement of the tubular wringing member allows the plurality of protruding ribs to engage the strands of the mop head to remove an amount of liquid from the mop head.

124 Claims, 3 Drawing Sheets

SELF-WRINGING MOP

BACKGROUND OF THE INVENTION

1. Field of the Invention

The present invention generally relates to the field of mops. More particularly, the present invention relates to the field of self-wringing mops for removing liquid from the mop.

2. Description of the Prior Art

Specifically, common mops are well known in the art and are generally referred as deck mops which are currently being used in households. These prior art deck mops are difficult and cumbersome to use. One disadvantage with prior art deck mops is that they require a separate wringing or squeezing device to remove or drain the liquid cleaning solution from the mop head. Therefore, the deck mop requires a separate wringing device in order to be effectively used.

Another prior art mop is known as a self-squeezing mop which eliminates the need for a separate wringing device. This self-squeezing mop typically incorporates a wringing device which is a squeeze ring located on one end of a cylinder and is sized to compress the strands of the mop head. The squeeze ring comprises a plurality of angular disposed stationary rollers. As the cylinder is pushed downwardly on the elongated mop handle, the stationary rollers engage and compress the strands of the mop head to drain the liquid cleaning solution from the mop head. The amount of liquid cleaning solution drained from the typical self-squeezing mop generally corresponds to the amount of pushing force exerted on the cylinder. Accordingly, one major drawback of the prior art self-squeezing mop is that it is very undesirable for people with less physical strength, especially elderly people.

The following eight (8) prior art patents are found to be pertinent to the field of the present invention:

1. U.S. Pat. No. 1,218,618 issued to Bauer on Mar. 13, 1917 for "Combined Mop And Wringer" (hereafter the "Bauer Patent");
2. U.S. Pat. No. 1,710,190 issued to Regan on Apr. 23, 1929 for "Combined Mop Holder And Wringer" (hereafter the "Regan Patent");
3. U.S. Pat. No. 2,066,096 issued to Currie on Dec. 29, 1936 for "Floor Mop" (hereafter the "Currie Patent");
4. U.S. Pat. No. 2,230,101 issued to Bakemeier on Jan. 28, 1941 for "Mop Holder And Wringer" (hereafter the "Bakemeier Patent");
5. U.S. Pat. No. 2,365,437 issued to Schaefer on Dec. 19, 1944 for "Mop" (hereafter the "Schaefer Patent");
6. U.S. Pat. No. 4,464,807 issued to Weiss on Aug. 14, 1984 for "Floor Mop" (hereafter the "Weiss Patent");
7. U.S. Pat. No. 5,509,163 issued to Morad on Apr. 23, 1996 for "Quick Squeezing Wringable Mop" (hereafter the "Morad Patent"); and
8. U.S. Pat. No. 5,724,694 issued to Lewis on Mar. 10, 1998 for "Self-Squeezing Mop" (hereafter the "Lewis Patent").

The Bauer Patent discloses a combined mop and wringer. It comprises an operating mechanism for imparting a rotary movement to one of the mop holding members whereby the initial twisting of the mop is effected at a comparatively rapid rate and the final twisting is accomplished by a slower and more powerful twisting movement.

The Regan Patent discloses a combined mop holder and wringer. It comprises a handle with a mop clamp at a lower end of the handle. Slidably mounted on the handle is a tubular sleeve, on the lower end of which is secured a loop mop holder. A reduced portion is located between the mop clamp and the loop mop holder, where a mop is wrapped around the reduced portion and held there by the mop clamp and the loop mop holder. A helical-shaped groove is formed in the surface of the handle and extends substantially from the upper end to the tubular sleeve. This helical-shaped groove, together with a sleeve nut serves the function of imparting a rotary movement to the handle when the mop is to be wrung, this being accomplished by sliding the sleeve nut along the handle from the upper end of the handle to the lower end of the handle. The sleeve nut is held by one hand and pulled downwardly on the handle while the tubular sleeve is grasped by the other hand. The sleeve nut is tightly gripped when it is pulled downwardly over the handle and a rotary movement is thus transmitted to the handle, and as the mop clamp is secured to the lower end of the handle, it will rotate with the handle while the loop which is secured to the tubular sleeve is held stationary with the other hand.

The Currie Patent discloses a floor mop. It comprises a handle with an open ended tube which serves as a cylinder to accommodate a reciprocatory plunger. The plunger has a head which is slidably fitted within the cylinder. The head of the plunger is a bearing to accommodate a rotary jointing knob on the inner end of a mop turning screw. Attached to the bottom of the handle is a stationary plate with a guide slot through which the mop turning screw works back and forth. This forms the means for converting the reciprocatory motion of the plunger into the rotary motion for an adapter fixture attached to the lower end of the mop turning screw.

The Bakemeier Patent discloses a mop holder and wringer. It comprises a handle which is formed with a longitudinal channel extending from the lower end to a major portion of the handle and communicates with a spiral extension. Mounted on the handle is a metal sleeve which serves as a hand hold. The sleeve has an inner bearing ball which enters the channel, causing the handle and the sleeve to rotate together, but when the sleeve is raised, this causes the ball to enter the spiral groove. The handle rotates when the sleeve is held to keep the sleeve from turning.

The Schaefer Patent discloses a mop. It comprises a handle with a mop secured at its lower end and a fabric stretching and wringing mechanism. The mechanism has a body portion in the form of a sleeve with an external spiral slot. Secured in a predetermined position on the mop handle is a pin or screw on which a roller head is rotatably mounted. The roller head sits on the handle and projects into the spiral groove of the sleeve so that when the sleeve is slidably moved on the mop handle, the sleeve is caused to rotate due to the coaction of the roller head working in the spiral groove of the sleeve.

The Weiss Patent discloses a floor mop which comprises a handle and a helicoidal screw-threaded groove.

The Morad Patent discloses a quick squeezing wringable mop which utilizes a spring-and-ratchet mechanism and longitudinal ribs on the handle.

The Lewis Patent discloses a self-squeezing mop. The Lewis Patent discloses a self-squeezing mop which employs a linear squeezing action to remove liquid carried by stranded, non-woven absorbent material. The mop has a mop head attached to a mop handle and a cylinder which travels longitudinally along a portion of the handle between a retracted position to an extended position. A squeeze ring is disposed about the axis of the cylinder comprising a plurality of rollers and arms disposed radially about the axis for compressing the strands of the mop head as the cylinder travels vertically from the retracted to the extended position. Each roller is mounted for rotation about a stationary axle. Accordingly, the rollers are restricted to rotational, rather than axial or lateral movement.

It is desirable to provide a very efficient and also very effective design and construction of a self-wringing mop for removing liquid from the strands of the mop head. It is also desirable to provide a self-wringing mop which does not require a separate wringing device for removing liquid from the mop head.

SUMMARY OF THE INVENTION

The present invention is a self-wringing mop for removing liquid from the strands of a mop head. The self-wringing mop comprises an elongated handle member, a tubular wringing member disposed over a lowermost portion of the handle member, a ratchet mechanism for longitudinal and rotational movement of the tubular wringing member, and the mop head attached to one end of the handle member just below the tubular wringing member.

The tubular wringing member has a plurality of spaced apart longitudinal protruding ribs which are integrally formed with the interior surface. The longitudinal and rotational movement of the tubular wringing member allows the plurality of protruding ribs to engage the strands of the mop head to remove an amount of liquid from the mop head.

It is an object of the present invention to provide a self-wringing mop with a tubular wringing member having a plurality of protruding ribs integrally formed with the interior surface so that the protruding ribs engage the strands of a mop head to remove excessive liquid from the mop head.

It is also an object of the present invention to provide a self-wringing mop with a tubular wringing member having a plurality of triangular shaped protruding ribs integrally formed with the interior surface so that the triangular shaped protruding ribs engage the strands of a mop head to remove excessive liquid from the mop head.

It is an additional object of the present invention to provide a self-wringing mop with a tubular wringing member having a plurality of spiral shaped protruding ribs integrally formed with the interior surface so that the spiral shaped protruding ribs engage the strands of a mop head to remove excessive liquid from the mop head.

It is a further object of the present invention to provide a self-wringing mop with a ratchet mechanism for assisting in longitudinal and rotational movement of the tubular wringing member to remove excessive liquid from the strands of the mop head. The ratchet mechanism includes a cylindrical shaped ratchet wheel and a pawl which engages with the cylindrical shaped ratchet wheel.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
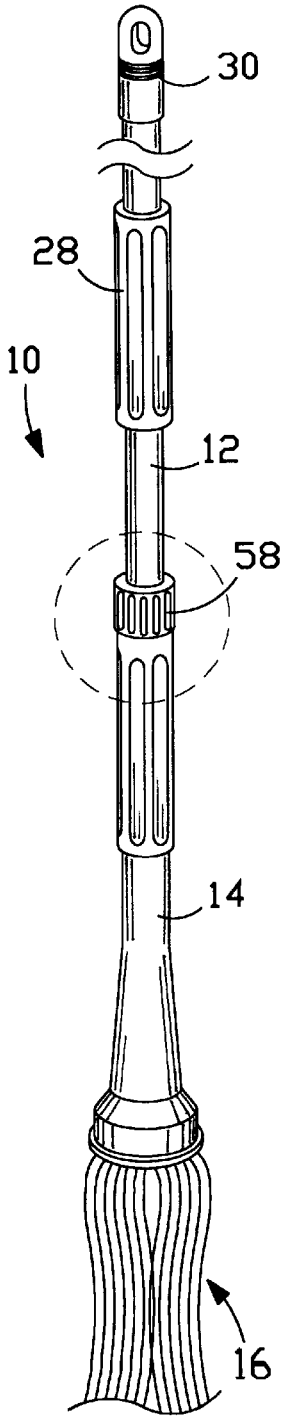
FIG. 1 is a perspective view of the preferred embodiment of the present invention self-wringing mop, showing the tubular wringing member in its retracted position.
Figure 2:
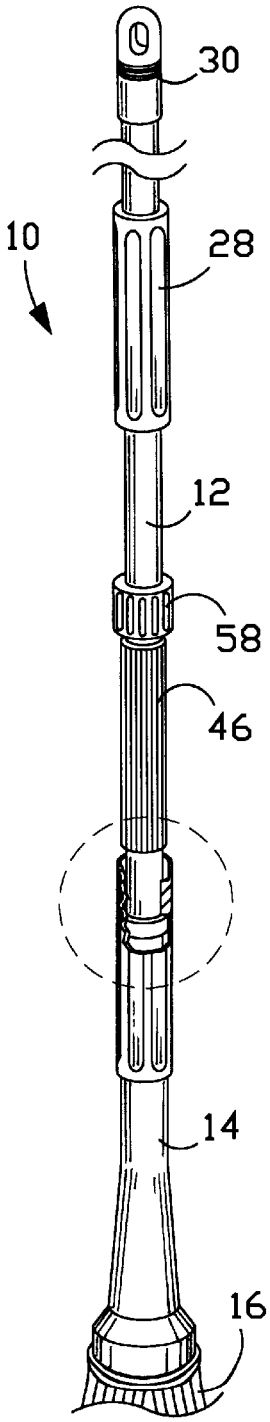
FIG. 2 is a perspective view of the present invention self-wringing mop, showing the tubular wringing member in its extended position.

Referring to FIGS. 1 and 2, there is depicted at 10 the present invention self-wringing mop which includes a handle member 12, a wringing member 14, and a mop head 16.

Figure 3:
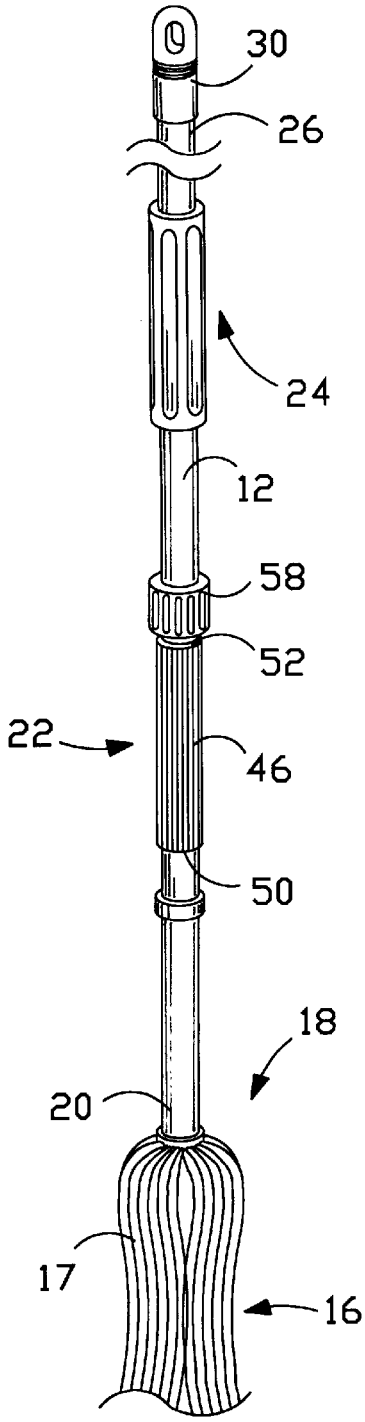
FIG. 3 is a perspective view of the present invention self-wringing mop shown in FIG. 1 without the tubular wringing member.
Figure 4:
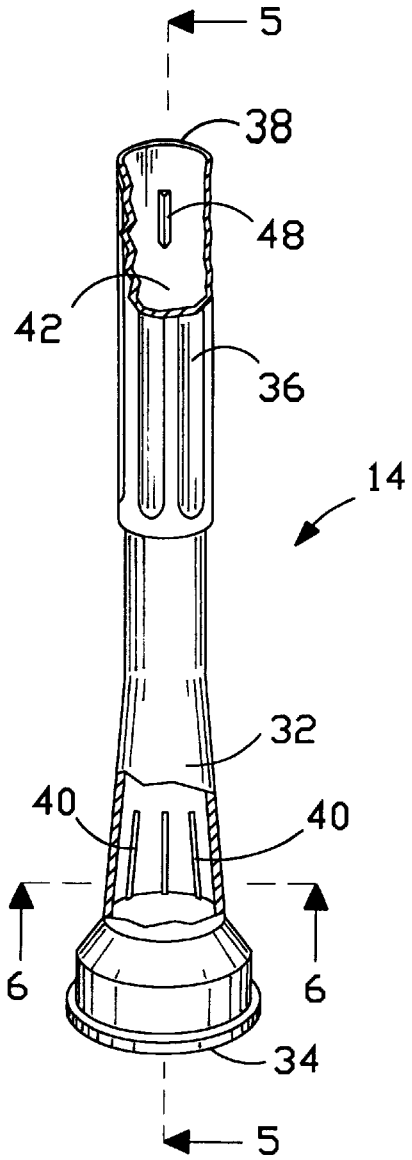
FIG. 4 is a perspective view of the tubular wringing member of the present invention self-wringing mop.
Figure 5:
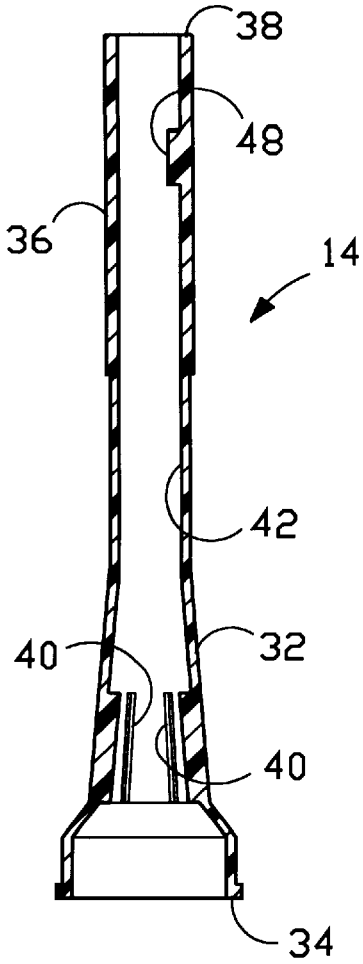
FIG. 5 is a cross-sectional view taken along line 5—5 of FIG. 4.
Figure 6:
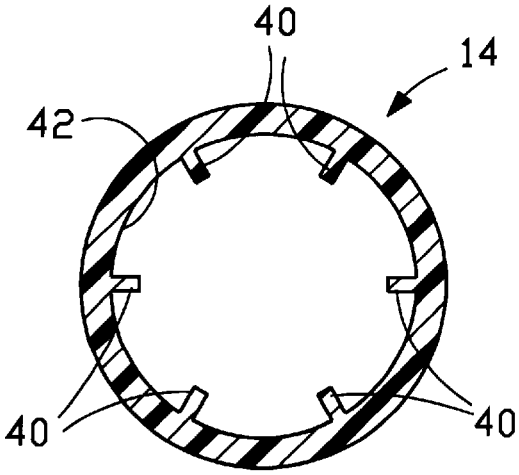
FIG. 6 is a cross-sectional view taken along line 6—6 of FIG. 4.
Figure 7:
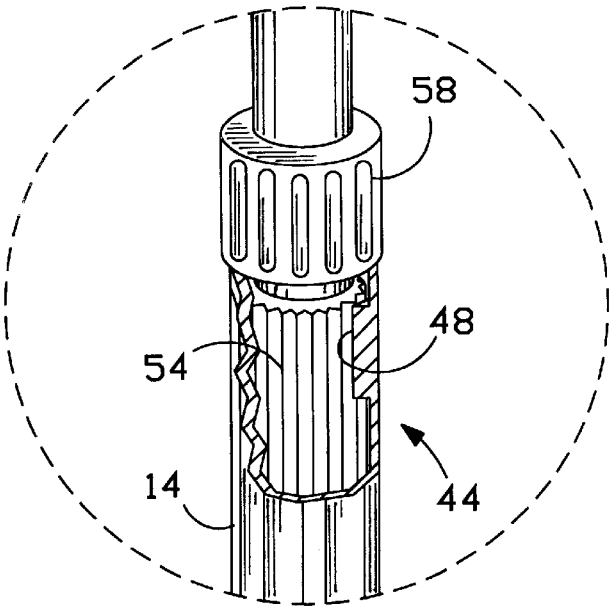
FIG. 7 is an enlarged partial view taken from within the dashed lines of FIG. 1.

Referring to FIGS. 1, 2 and 3, the handle member 12 is provided for manipulating the mop 10 in mopping or swabbing operations. The handle member 12 is generally an elongated cylindrical rod of conventional length and includes a proximal section 18 with a proximal end 20, a middle section 22, and a distal section 24 with a distal end 26. The proximal end 20 of the handle member 12 is adapted for releaseably attaching the mop head 16. A hand gripping section 28 is provided with the mop 10 and located on the distal section 24 of the handle member 12. There is also provided a ring attachment member 30 which is press-fitted onto the distal end 26 of the handle member 12 for hanging the mop 10 when not in use.

The mop head 16 is of conventional manufacture known in the art and the description thereof will not be described in detail. The mop head 16 may have a plurality of absorbent strands 17 which has first ends secured to an attachment means (not shown), where the attachment means is adapted to be removably attached to the proximal end 20 of the handle member 12 and is preferably threaded. Free ends of the strands 17 are unsecured, allowing the strands to act as a conventional mop head.

Referring to FIGS. 1, 2, 4, 5, and 6, the wringing member 14 has a generally hollow tubular body which includes a proximal section 32 with a widened proximal end 34, a distal section 36 with a narrow distal end 38, and a plurality of spaced apart longitudinal protruding ribs 40 which are integrally formed with the interior surface 42 along a small portion of the proximal section 32. The widened proximal end 34 covers the attachment means (not shown) and the first ends of the mop head 16. The distal section 36 can be utilized as a gripping handle section which includes a plurality of exterior knurls thereon. The tubular wringing member 14 is disposed about an axis and mounted substantially coaxially with the handle member 12 for longitudinal and rotational movement along the proximal section 18 of the handle member 12 between a retracted position (see FIG. 1) and an extended position (see FIG. 2).

Referring to FIGS. 2 through 7, there is shown a rachet mechanism 44 which includes a hollow cylindrical shaped ratchet wheel 46 and a pawl 48. The ratchet wheel 46 is press-fitted to and located on the middle section 22 of the handle member 12. The ratchet wheel 46 has a tapered first end 50, a second end 52, and a plurality of spaced apart longitudinal ribs 54 running lengthwise on the ratchet wheel 46. The ratchet wheel 46 is covered by the distal section 36 of the tubular wringing member 14 when the tubular wringing member 14 is in its retracted position.

The pawl 48 may be an inner claw which is integrally formed with the interior surface 42 of the tubular wringing member 14 and located adjacent to the distal end 38, where the tip of the pawl 48 engages with one of the plurality of ribs 54 of the ratchet wheel 46 as the tubular wringing member 14 is rotated and the handle member is stationary or the handle member is rotated and the wringing member 14 is stationary. The ratchet mechanism 44 assists a user for longitudinal and rotational movement of the tubular wringing member 14 with respect to the handle member 12. The rotational motion of the tubular wringing member 14 is governed by the ratchet mechanism 44. When the tubular wringing member 14 is rotated in its clockwise circular path, in which the protruding ribs 40 engage and compress the mop strands 52 of the mop head 16 inwardly to remove an amount of liquid carried by the mop head 16. The tubular wringing member 14 can be forced back upwardly to cover the ratchet wheel 46 such that the pawl 48 slides over the tapered first end 50 of the ratchet wheel 46.

The tubular wringing member 14 is normally rotated in the clockwise or counter-clockwise direction for wringing the mop head 16. The tubular wringing member 14 cannot rotate in the counter-clockwise direction because of the ratchet mechanism 44 which is a one-way ratchet mechanism which prevents this from occurring (the plurality of ribs are slanted in one direction for preventing undesirable rotation). It will be appreciated that the tubular wringing member 14 can be constructed to rotate in the counter-clockwise direction by reversing the position of the ratchet mechanism 44 in the opposite direction and reversing the longitudinal ribs 54 on the ratchet wheel 46, without departing from the spirit and scope of the present invention.

Figure 8:
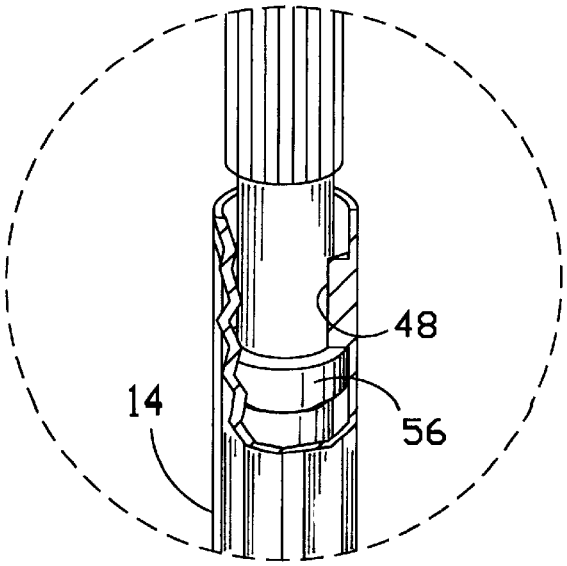
FIG. 8 is an enlarged partial view taken from within the dashed lines of FIG. 2.

Referring to FIGS. 2 and 8, there is shown stop collar means 56 which is attached to the proximal section 18 of the handle member 12. The stop collar means 56 prevents the proximal end 34 of the tubular wringing member 14 from extending beyond the free ends of the plurality of stands 17 of the mop head 16 when the pawl 48 abuts against the top of the stop collar means 56. The pawl 48 can travel back up on the ratchet wheel 46 because of the tapered first end 50 of the ratchet wheel 46.

Referring to FIGS. 1, 2, 3, and 7, there is depicted retaining means 58 which is further provided with the present invention mop 10. The retaining means 58 is located on the middle section 22 of the handle member 12 and located above the ratchet wheel 46, where the distal end 38 of the tubular wringing member 14 abuts against the retaining means 58 for retaining the tubular wringing member 14 in the retracted position.

Figure 9:
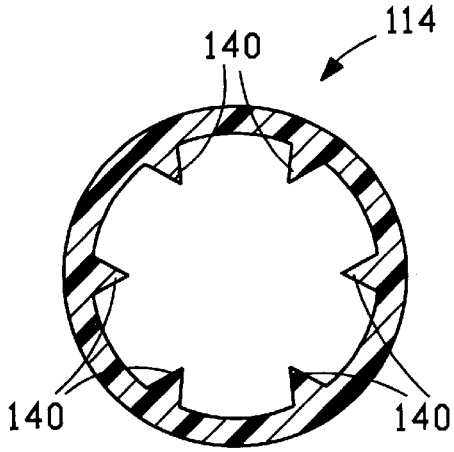
FIG. 9 is a cross-sectional view which is the same cross-sectional view shown in FIG. 6, showing an alternative arrangement of the plurality of wringing ribs which are triangular shaped ribs.

Referring to FIG. 9, there is depicted an alternative arrangement of the plurality of protruding ribs 140 of the tubular wringing member 114 of the present invention self-wringing mop. In this arrangement, the tubular wringing member 114 assembles and functions similar to the tubular wringing member 14 previously described above in FIGS. 1 through 8, and the only difference is the configuration of the plurality of protruding ribs 140 which are now generally triangular shaped.

Figure 10:
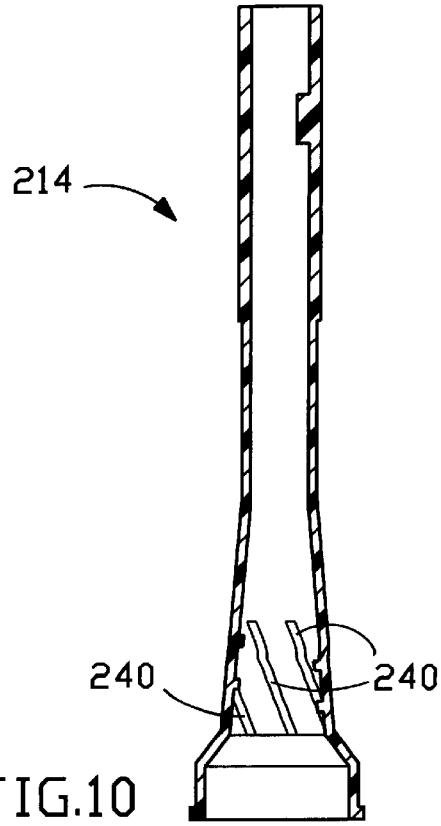
FIG. 10 is a cross-sectional view which is the same cross-sectional view shown in FIG. 5, showing another alternative arrangement of the plurality of wringing ribs which are spiral shaped ribs.

Referring to FIG. 10, there is depicted another alternative arrangement of the plurality of protruding ribs 240 of the tubular wringing member 214 of the present invention self-wringing mop. In this arrangement, the tubular wringing member 214 assembles and functions similar to the tubular wringing member 14 previously described above in FIGS. 1 through 8, and the only difference is the configuration of the plurality of protruding ribs 240 which are generally spiral shaped ribs.

Defined in detail, the present invention is a self-wringing mop, comprising: (a) an elongated handle member having a proximal section with a proximal end, a middle section, and a distal section with a distal end; (b) a mop head having a plurality of absorbent strands and removably attached to the proximal end of the handle member; (c) a hollow tubular wringing member disposed about an axis and mounted substantially coaxially for longitudinal and rotational movement along the proximal section of the handle member between a retracted position and an extended position, the tubular wringing member having a proximal end, a distal end, and a plurality of spaced apart longitudinal protruding ribs integrally formed with the interior surface along a portion of the tubular wringing member and located adjacent to the proximal end; (d) a ratchet mechanism including a hollow cylindrical shaped ratchet wheel attached to the middle section of the handle member and a pawl integrally formed with the interior surface of the tubular wringing member and located adjacent to the distal end, the ratchet wheel having a plurality of longitudinal ribs and being covered by the distal section of the tubular wringing member, where the pawl engages with the plurality of ribs of the ratchet wheel for assisting in longitudinal and rotational movement of the tubular wringing member so that the plurality of ribs on the tubular wringing member engage with the plurality of strands of the mop head to remove an amount of liquid carried by the plurality of strands of the mop head; and (e) a stop collar attached to the proximal section of the handle member for preventing the proximal end of the tubular wringing member from extending beyond free ends of the plurality of strands of the mop head.

Defined also in detail, the present invention is a self-wringing mop, comprising: (a) an elongated handle member having a proximal section with a proximal end, a middle section, and a distal section with a distal end; (b) a mop head having a plurality of absorbent strands and attached to the proximal end of the handle member; (c) a hollow tubular wringing member disposed about an axis and mounted substantially coaxially for longitudinal and rotational movement along the proximal section of the handle member between a retracted position and an extended position, the tubular wringing member having a proximal end, a distal end, and a plurality of spaced apart longitudinal protruding ribs integrally formed with the interior surface along a portion of the tubular wringing member and located adjacent to the proximal end; (d) a ratchet mechanism including a hollow cylindrical shaped ratchet wheel attached to the middle section of the handle member and a pawl integrally formed with the interior surface of the tubular wringing member and located adjacent to the distal end, the ratchet wheel having a plurality of longitudinal ribs and being covered by the distal section of the tubular wringing member, where the pawl engages with the plurality of ribs of the ratchet wheel for assisting in longitudinal and rotational movement of the tubular wringing member so that the plurality of ribs on the tubular wringing member engage with the plurality of strands of the mop head to remove an amount of liquid carried by the plurality of strands of the mop head; and (e) a stop collar attached to the proximal section of the handle member for preventing the proximal end of the tubular wringing member from extending beyond free ends of the plurality of strands of the mop head.

Defined broadly, the present invention is a mop, comprising: (a) a handle member having a proximal end and a distal end; (b) a mop head having a plurality of strands attached to the proximal end of the handle member; (c) a wringing member disposed about an axis and mounted substantially coaxially for longitudinal and rotational movement along a portion of the handle member between a retracted position and an extended position, the wringing member having a proximal end, a distal end, and a plurality of protruding ribs located on the interior surface of the wringing member and located adjacent to the proximal end; (d) a ratchet mechanism for assisting in the longitudinal and rotational movement of the wringing member such that the plurality of protruding ribs engage with the plurality of strands of the mop head for removing excessive amount of liquid carried by the mop head; and (e) means for preventing an engagement end of the wringing member from extending beyond free ends of the plurality of strands of the mop head.

Defined more broadly, the present invention is a mop, comprising: (a) a handle member having a proximal end and a distal end; (b) a mop head having a plurality of strands attached to the proximal end of the handle member; (c) a wringing member disposed about an axis and mounted substantially coaxially for longitudinal and rotational movement along a portion of the handle member between a retracted position and an extended position, the wringing member having a proximal end, a distal end, and a plurality of protruding ribs located on the interior surface of the wringing member and located adjacent to the proximal end; and (d) a mechanism for assisting in the longitudinal and rotational movement of the wringing member such that the plurality of protruding ribs engage with the plurality of strands of the mop head for removing excessive amount of liquid carried by the mop head.

Defined even more broadly, the present invention is a mop, comprising: (a) a handle having a first end and a second end; (b) a mop head having a plurality of absorbent strands attached to the first end of the handle; (c) wringing means disposed over the handle and having at least one protruding rib for engaging with the plurality of strands of the mop head; and (d) a ratchet mechanism for assisting in the longitudinal and rotational movement of the wringing means such that the at least one protruding rib engage with the plurality of strands of the mop head for removing excessive amount of liquid carried by the mop head.

Defined further more broadly, the present invention is a mop, comprising: (a) a handle having a first end and a second end; (b) a mop head having a plurality of absorbent strands attached to the first end of the handle; (c) wringing means disposed over the handle and having at least one protruding rib for engaging with the plurality of strands of the mop head; and (d) a mechanism for assisting in the longitudinal and rotational movement of the wringing means such that the at least one protruding rib engages with the plurality of strands of the mop head for removing excessive amount of liquid carried by the mop head.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A self-wringing mop, comprising:

a. an elongated handle member having a proximal section with a proximal end, a middle section, and a distal section with a distal end;

b. a mop head having a plurality of absorbent strands and removably attached to said proximal end of said handle member;

c. a hollow tubular wringing member disposed about an axis and mounted substantially coaxially for longitudinal and rotational movement along said proximal section of said handle member between a retracted position and an extended position, the tubular wringing member having a proximal end, a distal end, and a plurality of spaced apart longitudinal protruding ribs integrally formed with the interior surface along a portion of the tubular wringing member and located adjacent to said proximal end;

d. a ratchet mechanism including a hollow cylindrical shaped ratchet wheel attached to said middle section of said handle member and a pawl integrally formed with the interior surface of said tubular wringing member and located adjacent to said distal end, the ratchet wheel having a plurality of longitudinal ribs and being covered by said distal section of said tubular wringing member, where the pawl engages with the plurality of ribs of the ratchet wheel for assisting in longitudinal and rotational movement of said tubular wringing member so that said plurality of ribs on said tubular wringing member engage with said plurality of strands of said mop head to remove an amount of liquid carried by said plurality of strands of said mop head; and e. a stop collar attached to said proximal section of said handle member for preventing said proximal end of said tubular wringing member from extending beyond free ends of said plurality of strands of said mop head.

2. The self-wringing mop in accordance with claim 1 further comprising a ring attachment member press-fitted on said distal end of said handle member for hanging said self-wringing mop when not in use.

3. The self-wringing mop in accordance with claim 1 further comprising a hand gripping member attached on said distal section of said handle member.

4. The self-wringing mop in accordance with claim 1 further comprising retaining means located on said middle section of said handle member, where said distal end of said tubular wringing member abuts against the retaining means for retaining said tubular wringing member in the retracted position.

5. The self-wringing mop in accordance with claim 1 wherein said tubular wringing member further includes a hand gripping section located adjacent to said distal end.

6. The self-wringing mop in accordance with claim 5 wherein said hand gripping section has a plurality of exterior knurls.

7. A self-wringing mop, comprising:

a. an elongated handle member having a proximal section with a proximal end, a middle section, and a distal section with a distal end;

b. a mop head having a plurality of absorbent strands and attached to said proximal end of said handle member;

c. a hollow tubular wringing member disposed about an axis and mounted substantially coaxially for longitudinal and rotational movement along said proximal section of said handle member between a retracted position and an extended position, the tubular wringing member having a proximal end, a distal end, and a plurality of spaced apart longitudinal protruding ribs integrally formed with the interior surface along a portion of the tubular wringing member and located adjacent to said proximal end;

d. a ratchet mechanism including a hollow cylindrical shaped ratchet wheel attached to said middle section of said handle member and a pawl integrally formed with the interior surface of said tubular wringing member and located adjacent to said distal end, the ratchet wheel having a plurality of longitudinal ribs and being covered by said distal section of said tubular wringing member, where the pawl engages with the plurality of ribs of the ratchet wheel for assisting in longitudinal and rotational movement of said tubular wringing member so that said plurality of ribs on said tubular wringing member engage with said plurality of strands of said mop head to remove an amount of liquid carried by said plurality of strands of said mop head; and e. a stop collar attached to said proximal section of said handle member for preventing said proximal end of said tubular wringing member from extending beyond free ends of said plurality of strands of said mop head.

8. A mop, comprising:

a. a handle member having a proximal end and a distal end;

b. a mop head having a plurality of strands attached to said proximal end of said handle member;

c. a wringing member disposed about an axis and mounted substantially coaxially for longitudinal and rotational movement along a portion of said handle member between a retracted position and an extended position, the wringing member having a proximal end, a distal end, and a plurality of protruding ribs located on the interior surface of the wringing member and located adjacent to the proximal end;

d. a ratchet mechanism for assisting in the longitudinal and rotational movement of said wringing member such that said plurality of protruding ribs engage with said plurality of strands of said mop head for removing excessive amount of liquid carried by said mop head; and e. means for preventing an engagement end of said wringing member from extending beyond free ends of said plurality of strands of said mop head.

9. The mop in accordance with claim 8 further comprising a ring attachment member press-fitted on said distal end of said handle member for hanging said mop when not in use.

10. The mop in accordance with claim 8 further comprising a hand gripping member attached on said handle member and located adjacent to said distal end.

11. The mop in accordance with claim 8 further comprising retaining means attached to said handle member, where said distal end of said wringing member abuts against the retaining means for retaining said wringing member in the retracted position.

12. The mop in accordance with claim 8 wherein said wringing member further includes a hand gripping section located adjacent to said distal end.

13. The mop in accordance with claim 12 wherein said hand gripping section has a plurality of exterior knurls.

14. The mop in accordance with claim 8 wherein said ratchet mechanism includes a cylindrical shaped ratchet wheel attached to said handle member and a pawl integrally formed on the interior surface of said wringing member for engaging with the cylindrical shaped ratchet wheel.

15. The mop in accordance with claim 8 wherein said plurality of protruding ribs are generally spiral shape.

16. The mop in accordance with claim 8 wherein said plurality of protruding ribs are generally in a vertical direction.

17. The mop in accordance with claim 8 wherein said plurality of protruding ribs are generally triangular shape.

18. The mop in accordance with claim 8 wherein said preventing means includes a stop collar attached to said handle member.

19. The mop in accordance with claim 8 wherein said plurality of strands of the mop are releaseably attached to said proximal end of said handle member.

20. A mop, comprising:

a. a handle member having a proximal end and a distal end;

b. a mop head having a plurality of strands attached to said proximal end of said handle member;

c. a wringing member disposed about an axis and mounted substantially coaxially for longitudinal and rotational movement along a portion of said handle member between a retracted position and an extended position, the wringing member having a proximal end, a distal end, and a plurality of protruding ribs located on the interior surface of the wringing member and located adjacent to the proximal end; and d. a mechanism for assisting in the longitudinal and rotational movement of said wringing member such that said plurality of protruding ribs are rotatably and movably engaged with said plurality of strands of said mop head as said wringing member is turning and traveling downwardly from said retracted position to said extended position for removing excessive amount of liquid carried by said mop head.

21. The mop in accordance with claim 20 further comprising means for preventing an engagement end of said wringing member from extending beyond free ends of said plurality of strands of said mop head.

22. The mop in accordance with claim 21 wherein said preventing means includes a stop collar attached to said handle member.

23. The mop in accordance with claim 20 further comprising a ring attachment member press-fitted on said distal end of said handle member for hanging said mop when not in use.

24. The mop in accordance with claim 20 further comprising a hand gripping member attached on said handle member and located adjacent to said distal end.

25. The mop in accordance with claim 20 further comprising retaining means attached to said handle member, where said distal end of said wringing member abuts against the retaining means for retaining said wringing member in the retracted position.

26. The mop in accordance with claim 20 wherein said wringing member further includes a hand gripping section located adjacent to said distal end.

27. The mop in accordance with claim 26 wherein said hand gripping section has a plurality of exterior knurls.

28. The mop in accordance with claim 20 wherein said mechanism includes a cylindrical shaped ratchet wheel attached to said handle member and a pawl integrally formed on the interior surface of said wringing member for engaging with the cylindrical shaped ratchet wheel.

29. The mop in accordance with claim 20 wherein said plurality of protruding ribs are generally spiral shape.

30. The mop in accordance with claim 20 wherein said plurality of protruding ribs are generally in a vertical direction.

31. The mop in accordance with claim 20 wherein said plurality of protruding ribs are generally triangular shape.

32. The mop in accordance with claim 20 wherein said plurality of strands of said mop are releaseably attached to said proximal end of said handle member.

33. A mop, comprising:

a. a handle having a first end and a second end;

b. a mop head having a plurality of absorbent strands attached to said first end of said handle;

c. wringing means disposed over said handle and having at least one protruding rib for engaging with said plurality of strands of said mop head; and d. a ratchet mechanism for assisting in the longitudinal and rotational movement of said wringing means such that said at least one protruding rib is rotatably and movably engaged with said plurality of strands of said mop head as said wringing means is turning and traveling downwardly along said handle for removing excessive amount of liquid carried by said mop head.

34. The mop in accordance with claim 33 wherein said wringing means further includes an exterior gripping section.

35. The mop in accordance with claim 34 wherein said gripping section has a plurality of exterior knurls for gripping with a user's hand.

36. The mop in accordance with claim 33 wherein said ratchet mechanism includes a cylindrical shaped ratchet wheel attached to said handle and a pawl integrally formed on the interior surface of said wringing means for engaging with the cylindrical shaped ratchet wheel.

37. The mop in accordance with claim 33 wherein said at least one protruding rib is generally spiral shape.

38. The mop in accordance with claim 33 wherein said at least one protruding rib is generally in a vertical direction.

39. The mop in accordance with claim 33 wherein said at least one protruding rib is generally triangular shape.

40. The mop in accordance with claim 33 further comprising retaining means for retaining said wringing means in a stored or unused position.

41. The mop in accordance with claim 33 further comprising means for preventing an engagement end of said wringing means from extending beyond free ends of said plurality of strands of said mop head.

42. The mop in accordance with claim 41 wherein said preventing means includes a stop collar attached to said handle member.

43. A mop, comprising:

a. a handle having a first end and a second end;

b. a mop head having a plurality of absorbent strands attached to said first end of said handle;

c. wringing means disposed over said handle and having at least one protruding rib for engaging with said plurality of strands of said mop head; and d. a mechanism for assisting in the longitudinal and rotational movement of said wringing means such that said at least one protruding rib is rotatably and movably engaged with said plurality of strands of said mop head as said wringing means is turning and traveling downwardly along said handle for removing excessive amount of liquid carried by said mop head.

44. The mop in accordance with claim 43 wherein said wringing means further includes an exterior gripping section.

45. The mop in accordance with claim 44 wherein said gripping section has a plurality of exterior knurls for gripping with a user's hand.

46. The mop in accordance with claim 43 wherein said mechanism includes a cylindrical shaped ratchet wheel attached to said handle and a pawl integrally formed on the interior surface of said wringing means for engaging with the cylindrical shaped ratchet wheel.

47. The mop in accordance with claim 43 wherein said at least one protruding rib is generally spiral shape.

48. The mop in accordance with claim 43 wherein said at least one protruding rib is generally in a vertical direction.

49. The mop in accordance with claim 43 wherein said at least one protruding rib is generally triangular shape.

50. The mop in accordance with claim 43 further comprising retaining means for retaining said wringing means in a stored or unused position.

51. The mop in accordance with claim 43 further comprising means for preventing an engagement end of said wringing means from extending beyond free ends of said plurality of strands of said mop head.

52. The mop in accordance with claim 51 wherein said preventing means includes a stop collar attached to said handle member.

53. A mop, comprising:

a. a handle member having a proximal end and a distal end;

b. a mop head having a plurality of strands attached to said proximal end of said handle member;

c. a wringing member disposed about an axis and mounted substantially coaxially for longitudinal and rotational movement along a portion of said handle member between a retracted position and an extended position, the wringing member having a proximal end, a distal end, and a plurality of protruding ribs located on the interior surface of the wringing member and located adjacent to the proximal end;

d. a mechanism for assisting in the longitudinal and rotational movement of said wringing member such that said plurality of protruding ribs engage with said plurality of strands of said mop head for removing excessive amount of liquid carried by said mop head; and e. means for preventing an engagement end of said wringing member from extending beyond free ends of said plurality of strands of said mop head.

54. The mop in accordance with claim 53 wherein said preventing means includes a stop collar attached to said handle member.

55. The mop in accordance with claim 53 further comprising a ring attachment member press-fitted on said distal end of said handle member for hanging said mop when not in use.

56. The mop in accordance with claim 53 further comprising a hand gripping member attached on said handle member and located adjacent to said distal end.

57. The mop in accordance with claim 53 further comprising retaining means attached to said handle member, where said distal end of said wringing member abuts against the retaining means for retaining said wringing member in the retracted position.

58. The mop in accordance with claim 53 wherein said wringing member further includes a hand gripping section located adjacent to said distal end.

59. The mop in accordance with claim 58 wherein said hand gripping section has a plurality of exterior knurls.

60. The mop in accordance with claim 53 wherein said mechanism includes a cylindrical shaped ratchet wheel attached to said handle member and a pawl integrally formed on the interior surface of said wringing member for engaging with the cylindrical shaped ratchet wheel.

61. The mop in accordance with claim 53 wherein said plurality of protruding ribs are generally spiral shape.

62. The mop in accordance with claim 53 wherein said plurality of protruding ribs are generally in a vertical direction.

63. The mop in accordance with claim 53 wherein said plurality of protruding ribs are generally triangular shape.

64. The mop in accordance with claim 53 wherein said plurality of strands of said mop are releaseably attached to said proximal end of said handle member.

65. A mop, comprising:

a. a handle member having a proximal end and a distal end;

b. a mop head having a plurality of strands attached to said proximal end of said handle member;

c. a wringing member disposed about an axis and mounted substantially coaxially for longitudinal and rotational movement along a portion of said handle member between a retracted position and an extended position, the wringing member having a proximal end, a distal end, and a plurality of protruding ribs located on the interior surface of the wringing member and located adjacent to the proximal end;

d. a mechanism for assisting in the longitudinal and rotational movement of said wringing member such that said plurality of protruding ribs engage with said plurality of strands of said mop head for removing excessive amount of liquid carried by said mop head; and e. retaining means attached to said handle member, where said distal end of said wringing member abuts against the retaining means for retaining said wringing member in said retracted position.

66. The mop in accordance with claim 65 further comprising means for preventing an engagement end of said wringing member from extending beyond free ends of said plurality of strands of said mop head.

67. The mop in accordance with claim 66 wherein said preventing means includes a stop collar attached to said handle member.

68. The mop in accordance with claim 65 further comprising a ring attachment member press-fitted on said distal end of said handle member for hanging said mop when not in use.

69. The mop in accordance with claim 65 further comprising a hand gripping member attached on said handle member and located adjacent to said distal end.

70. The mop in accordance with claim 65 wherein said wringing member further includes a hand gripping section located adjacent to said distal end.

71. The mop in accordance with claim 70 wherein said hand gripping section has a plurality of exterior knurls.

72. The mop in accordance with claim 65 wherein said mechanism includes a cylindrical shaped ratchet wheel attached to said handle member and a pawl integrally formed on the interior surface of said wringing member for engaging with the cylindrical shaped ratchet wheel.

73. The mop in accordance with claim 65 wherein said plurality of protruding ribs are generally spiral shape.

74. The mop in accordance with claim 65 wherein said plurality of protruding ribs are generally in a vertical direction.

75. The mop in accordance with claim 65 wherein said plurality of protruding ribs are generally triangular shape.

76. The mop in accordance with claim 65 wherein said plurality of strands of said mop are releaseably attached to said proximal end of said handle member.

77. A mop, comprising:

a. a handle member having a proximal end and a distal end;

b. a mop head having a plurality of strands attached to said proximal end of said handle member;

c. a wringing member disposed about an axis and mounted substantially coaxially for longitudinal and rotational movement along a portion of said handle member between a retracted position and an extended position, the wringing member having a proximal end, a distal end, and a plurality of protruding ribs located on the interior surface of the wringing member and located adjacent to the proximal end;

d. a mechanism for assisting in the longitudinal and rotational movement of said wringing member such that said plurality of protruding ribs engage with said plurality of strands of said mop head for removing excessive amount of liquid carried by said mop head; and e. said mechanism including a cylindrical shaped ratchet wheel attached to said handle member and a pawl integrally formed on the interior surface of said wringing member for engaging with the cylindrical shaped ratchet wheel.

78. The mop in accordance with claim 77 further comprising means for preventing an engagement end of said wringing member from extending beyond free ends of said plurality of strands of said mop head.

79. The mop in accordance with claim 78 wherein said preventing means includes a stop collar attached to said handle member.

80. The mop in accordance with claim 77 further comprising a ring attachment member press-fitted on said distal end of said handle member for hanging said mop when not in use.

81. The mop in accordance with claim 77 further comprising a hand gripping member attached on said handle member and located adjacent to said distal end.

82. The mop in accordance with claim 77 further comprising retaining means attached to said handle member, where said distal end of said wringing member abuts against the retaining means for retaining said wringing member in the retracted position.

83. The mop in accordance with claim 77 wherein said wringing member further includes a hand gripping section located adjacent to said distal end.

84. The mop in accordance with claim 83 wherein said hand gripping section has a plurality of exterior knurls.

85. The mop in accordance with claim 77 wherein said plurality of protruding ribs are generally spiral shape.

86. The mop in accordance with claim 77 wherein said plurality of protruding ribs are generally in a vertical direction.

87. The mop in accordance with claim 77 wherein said plurality of protruding ribs are generally triangular shape.

88. The mop in accordance with claim 77 wherein said plurality of strands of said mop are releaseably attached to said proximal end of said handle member.

89. A mop, comprising:

a. a handle having a first end and a second end;

b. a mop head having a plurality of absorbent strands attached to said first end of said handle;

c. wringing means disposed over said handle and having at least one protruding rib for engaging with said plurality of strands of said mop head;

d. a ratchet mechanism for assisting in the longitudinal and rotational movement of said wringing means such that said at least one protruding rib engages with said plurality of strands of said mop head for removing excessive amount of liquid carried by said mop head; and e. said ratchet mechanism including a cylindrical shaped ratchet wheel attached to said handle and a pawl integrally formed on the interior surface of said wringing means for engaging with the cylindrical shaped ratchet wheel.

90. The mop in accordance with claim 89 wherein said wringing means further includes an exterior gripping section.

91. The mop in accordance with claim 90 wherein said gripping section has a plurality of exterior knurls for gripping with a user's hand.

92. The mop in accordance with claim 89 wherein said at least one protruding rib is generally spiral shape.

93. The mop in accordance with claim 89 wherein said at least one protruding rib is generally in a vertical direction.

94. The mop in accordance with claim 89 wherein said at least one protruding rib is generally triangular shape.

95. The mop in accordance with claim 89 further comprising retaining means for retaining said wringing means in a stored or unused position.

96. The mop in accordance with claim 89 further comprising means for preventing an engagement end of said wringing means from extending beyond free ends of said plurality of strands of said mop head.

97. The mop in accordance with claim 96 wherein said preventing means includes a stop collar attached to said handle member.

98. A mop, comprising:

a. a handle having a first end and a second end;

b. a mop head having a plurality of absorbent strands attached to said first end of said handle;

c. wringing means disposed over said handle and having at least one protruding rib for engaging with said plurality of strands of said mop head;

d. a ratchet mechanism for assisting in the longitudinal and rotational movement of said wringing means such that said at least one protruding rib engages with said plurality of strands of said mop head for removing excessive amount of liquid carried by said mop head; and e. means for preventing an engagement end of said wringing means from extending beyond free ends of said plurality of strands of said mop head.

99.The mop in accordance with claim 98 wherein said wringing means further includes an exterior gripping section.

100. The mop in accordance with claim 99 wherein said gripping section has a plurality of exterior knurls for gripping with a user's hand.

101. The mop in accordance with claim 98 wherein said ratchet mechanism includes a cylindrical shaped ratchet wheel attached to said handle and a pawl integrally formed on the interior surface of said wringing means for engaging with the cylindrical shaped ratchet wheel.

102. The mop in accordance with claim 98 wherein said at least one protruding rib is generally spiral shape.

103. The mop in accordance with claim 98 wherein said at least one protruding rib is generally in a vertical direction.

104. The mop in accordance with claim 98 wherein said at least one protruding rib is generally triangular shape.

105. The mop in accordance with claim 98 further comprising retaining means for retaining said wringing means in a stored or unused position.

106. The mop in accordance with claim 105 wherein said preventing means includes a stop collar attached to said handle member.

107. A mop, comprising:

a. a handle having a first end and a second end;

b. a mop head having a plurality of absorbent strands attached to said first end of said handle;

c. wringing means disposed over said handle and having at least one protruding rib for engaging with said plurality of strands of said mop head;

d. a mechanism for assisting in the longitudinal and rotational movement of said wringing means such that said at least one protruding rib engages with said plurality of strands of said mop head for removing excessive amount of liquid carried by said mop head; and e. said mechanism including a cylindrical shaped ratchet wheel attached to said handle and a pawl integrally formed on the interior surface of said wringing means for engaging with the cylindrical shaped ratchet wheel.

108. The mop in accordance with claim 107 wherein said wringing means further includes an exterior gripping section.

109. The mop in accordance with claim 108 wherein said gripping section has a plurality of exterior knurls for gripping with a user's hand.

110. The mop in accordance with claim 107 wherein said at least one protruding rib is generally spiral shape.

111. The mop in accordance with claim 107 wherein said at least one protruding rib is generally in a vertical direction.

112. The mop in accordance with claim 107 wherein said at least one protruding rib is generally triangular shape.

113. The mop in accordance with claim 107 further comprising retaining means for retaining said wringing means in a stored or unused position.

114. The mop in accordance with claim 107 further comprising means for preventing an engagement end of said wringing means from extending beyond free ends of said plurality of strands of said mop head.

115. The mop in accordance with claim 114 wherein said preventing means includes a stop collar attached to said handle member.

116. A mop, comprising:

a. a handle having a first end and a second end;

b. a mop head having a plurality of absorbent strands attached to said first end of said handle;

c. wringing means disposed over said handle and having at least one protruding rib for engaging with said plurality of strands of said mop head;

d. a mechanism for assisting in the longitudinal and rotational movement of said wringing means such that said at least one protruding rib engages with said plurality of strands of said mop head for removing excessive amount of liquid carried by said mop head; and e. means for preventing an engagement end of said wringing means from extending beyond free ends of said plurality of strands of said mop head.

117. The mop in accordance with claim 116 wherein said wringing means further includes an exterior gripping section.

118. The mop in accordance with claim 117 wherein said gripping section has a plurality of exterior knurls for gripping with a user's hand.

119. The mop in accordance with claim 116 wherein said mechanism includes a cylindrical shaped ratchet wheel attached to said handle and a pawl integrally formed on the interior surface of said wringing means for engaging with the cylindrical shaped ratchet wheel.

120. The mop in accordance with claim 116 wherein said at least one protruding rib is generally spiral shape.

121. The mop in accordance with claim 116 wherein said at least one protruding rib is generally in a vertical direction.

122. The mop in accordance with claim 116 wherein said at least one protruding rib is generally triangular shape.

123. The mop in accordance with claim 116 further comprising retaining means for retaining said wringing means in a stored or unused position.

124. The mop in accordance with claim 116 wherein said preventing means includes a stop collar attached to said handle member.

* * * * *